US008550964B2

(12) United States Patent
Ish, III et al.

(10) Patent No.: US 8,550,964 B2
(45) Date of Patent: Oct. 8, 2013

(54) RESISTANCE TRAINING APPARATUS AND METHODS

(75) Inventors: A. Buell Ish, III, Redmond, WA (US); L. Kent Lines, Carnation, WA (US); Robert A. Rasmussen, Bellevue, WA (US); Mark Tollison, San Diego, CA (US)

(73) Assignee: Vectra Fitness, Inc., Redmond, WA (US)

( * ) Notice: Subject to any disclaimer, the term of this patent is extended or adjusted under 35 U.S.C. 154(b) by 0 days.

(21) Appl. No.: 12/505,119

(22) Filed: Jul. 17, 2009

(65) Prior Publication Data

US 2011/0028281 A1 Feb. 3, 2011

(51) Int. Cl.
*A63B 21/068* (2006.01)
*A63B 21/16* (2006.01)

(52) U.S. Cl.
USPC ..... 482/95; 482/103; 482/138; 482/143

(58) Field of Classification Search
USPC ..... 482/95–97, 103, 139, 143, 23, 24, 102, 482/138
See application file for complete search history.

(56) References Cited

U.S. PATENT DOCUMENTS

| | | | | | |
|---|---|---|---|---|---|
| 321,388 | A * | 6/1885 | Ruebsam | 482/102 |
| 938,045 | A * | 10/1909 | Pay | 482/92 |
| 3,792,860 | A * | 2/1974 | Selnes | 482/95 |
| 3,877,421 | A * | 4/1975 | Brown | 601/23 |
| 4,900,018 | A * | 2/1990 | Ish et al. | 482/138 |
| 5,176,602 | A * | 1/1993 | Roberts | 482/131 |
| 5,201,694 | A * | 4/1993 | Zappel | 482/133 |
| 5,298,004 | A * | 3/1994 | Davis | 482/99 |
| 5,588,942 | A * | 12/1996 | Dillard | 482/139 |
| 6,258,011 | B1 * | 7/2001 | Wolfe | 482/23 |
| 6,443,877 | B1 * | 9/2002 | Hoecht et al. | 482/103 |
| 6,692,416 | B1 * | 2/2004 | Davis | 482/139 |
| 7,066,866 | B1 * | 6/2006 | Mobley | 482/40 |
| 7,090,622 | B2 * | 8/2006 | Hetrick | 482/92 |
| 7,166,066 | B2 * | 1/2007 | Webber | 482/100 |
| 7,255,666 | B2 * | 8/2007 | Cardenas | 482/143 |
| 7,316,634 | B2 * | 1/2008 | Webber | 482/93 |
| 7,455,634 | B2 * | 11/2008 | Barniak | 482/143 |
| 7,632,221 | B1 * | 12/2009 | Kolander | 482/94 |
| 7,662,073 | B1 * | 2/2010 | Baldwin | 482/92 |
| 7,722,509 | B2 * | 5/2010 | Eder | 482/99 |
| 7,909,742 | B2 * | 3/2011 | Ish et al. | 482/97 |
| 7,922,632 | B2 * | 4/2011 | Chou | 482/103 |
| 7,998,036 | B2 * | 8/2011 | Ish, III | 482/100 |
| 8,057,368 | B1 * | 11/2011 | Lyszczarz | 482/103 |
| 8,251,877 | B2 * | 8/2012 | Rasmussen et al. | 482/100 |
| 2006/0189462 | A1 * | 8/2006 | Pearson et al. | 482/142 |
| 2010/0016129 | A1 * | 1/2010 | Chou | 482/97 |

* cited by examiner

*Primary Examiner* — Loan Thanh
*Assistant Examiner* — Victor K Hwang

(57) ABSTRACT

Resistance training apparatus and methods are disclosed. In one embodiment, an exercise assembly includes an exercise station having a support portion and at least one user interface operatively coupled to the support portion by an anchor assembly. The anchor assembly includes a housing attached to the support portion, and a coupling device pivotably attached to the housing and moveable throughout an angular range, the coupling device being coupled to the at least one user interface and configured to move through at least a portion of the angular range during use of the at least one user interface.

14 Claims, 9 Drawing Sheets

RESISTANCE TRAINING APPARATUS AND METHODS

FIELD OF THE INVENTION

The present disclosure relates to exercise equipment, and more specifically, to resistance training apparatus and methods.

BACKGROUND

The advantages of weight-training exercise machines are widely recognized. Conventional weight-training exercise machines may feature single or multiple stations which enable a user to perform one or a variety of exercises for developing and toning different muscle groups. For example, the various stations of such exercise machines may include one or more stations that enable a user to exercise muscles of the arms and upper body using "press," "shrug," or "curl" types of movements, and one or more stations for exercising muscles of the legs using "squat," "press," or "extension" types of movements. Such weight machines provide the desired muscle training capability in a convenient, safe, and efficient manner. Although prior art exercise apparatus have achieved desirable results, novel apparatus and methods that provide improved versatility would have considerable utility.

SUMMARY

Embodiments of resistance training apparatus and methods may provide improved versatility in comparison with prior art exercise apparatus. In one embodiment, an exercise assembly includes an exercise station having a support portion and at least one user interface operatively coupled to the support portion by an anchor assembly. The anchor assembly includes a housing attached to the support portion, and a coupling device pivotably attached to the housing and moveable throughout an angular range, the coupling device being coupled to the at least one user interface and configured to move through at least a portion of the angular range during use of the at least one user interface.

BRIEF DESCRIPTION OF THE DRAWINGS

Embodiments of the invention are described in detail below with reference to the following drawings.

DETAILED DESCRIPTION

The present disclosure teaches resistance training apparatus and methods. Many specific details of certain embodiments of the invention are set forth in the following description and in FIGS. 1-13 to provide a thorough understanding of such embodiments. One skilled in the art, however, will understand that the present invention may have additional embodiments, or that the present invention may be practiced without several of the details described in the following description.

Figure 1:
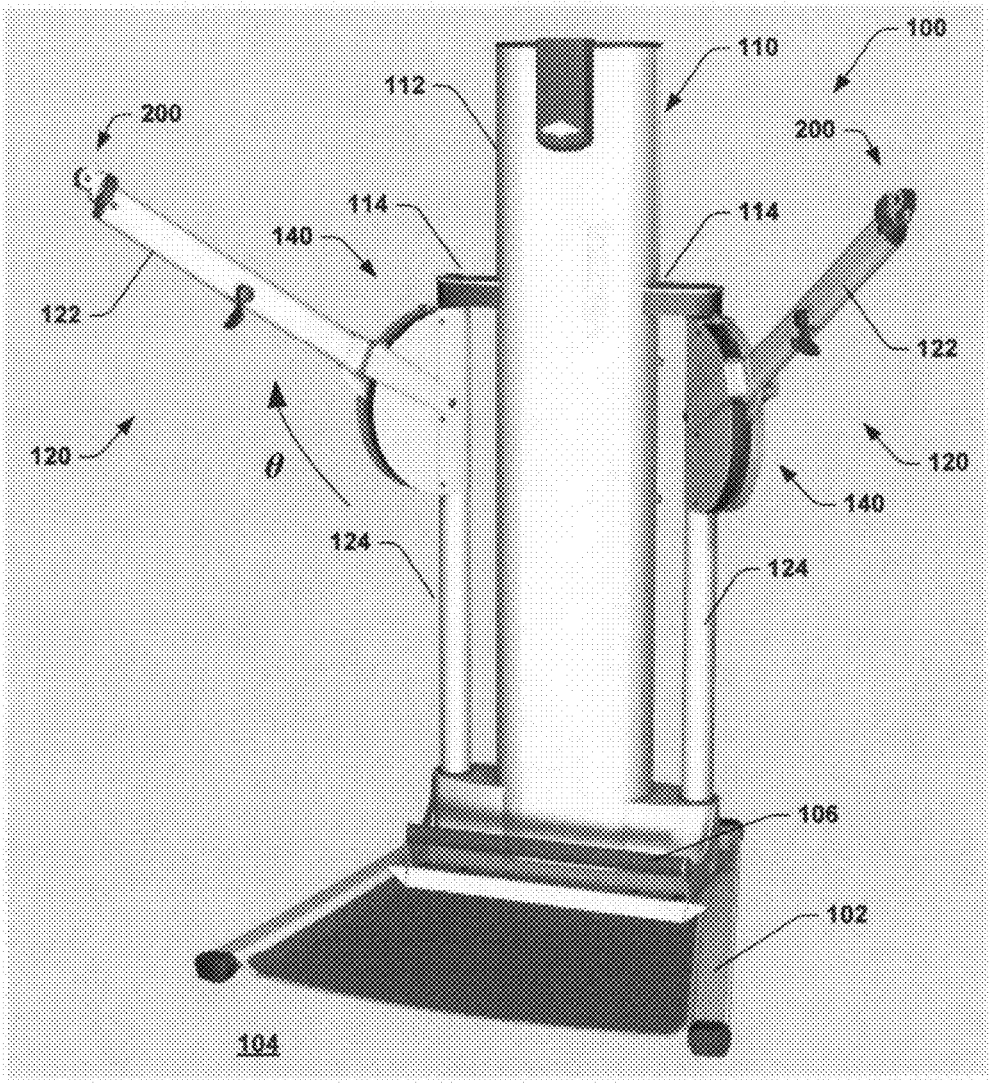
FIG. 1 is an isometric view of an exercise assembly in accordance with an embodiment of the invention.

For example, FIG. 1 is an isometric view of an exercise assembly 100 in accordance with an embodiment of the invention. In this embodiment, the exercise assembly 100 includes a pair of exercise stations 120, wherein each exercise station 120 includes an outwardly extending arm 122. A multi-variable assembly 200 is coupled to a distal end of each arm 122. A handle (not shown in FIG. 1) may be coupled to each multi-variable assembly 200 for performing resistance exercises in accordance with the teachings of the present disclosure, as described more fully below.

As further shown in FIG. 1, the exercise assembly 100 includes an upwardly extending central portion 110 coupled to a base assembly 102 that rests on a support surface 104 (e.g. a floor). The base assembly 102 may include a foot bar 106 for engaging a user's feet during an exercise. The central portion 110 includes a shield member 112 and a pair of support members 114 that extend laterally outwardly from the shield member 112. Each exercise station 120 includes an arm 122 coupled to an upright support 124 by a first adjustment assembly 140. Each upright support 124 extends from the support member 114 of the central portion 110 to the base assembly 102. The first adjustment assembly 140 of each exercise stations 120 provides adjustability of the position of each arm 122 (e.g. angular position θ as desired by the user, as described more fully below.

Figure 2:
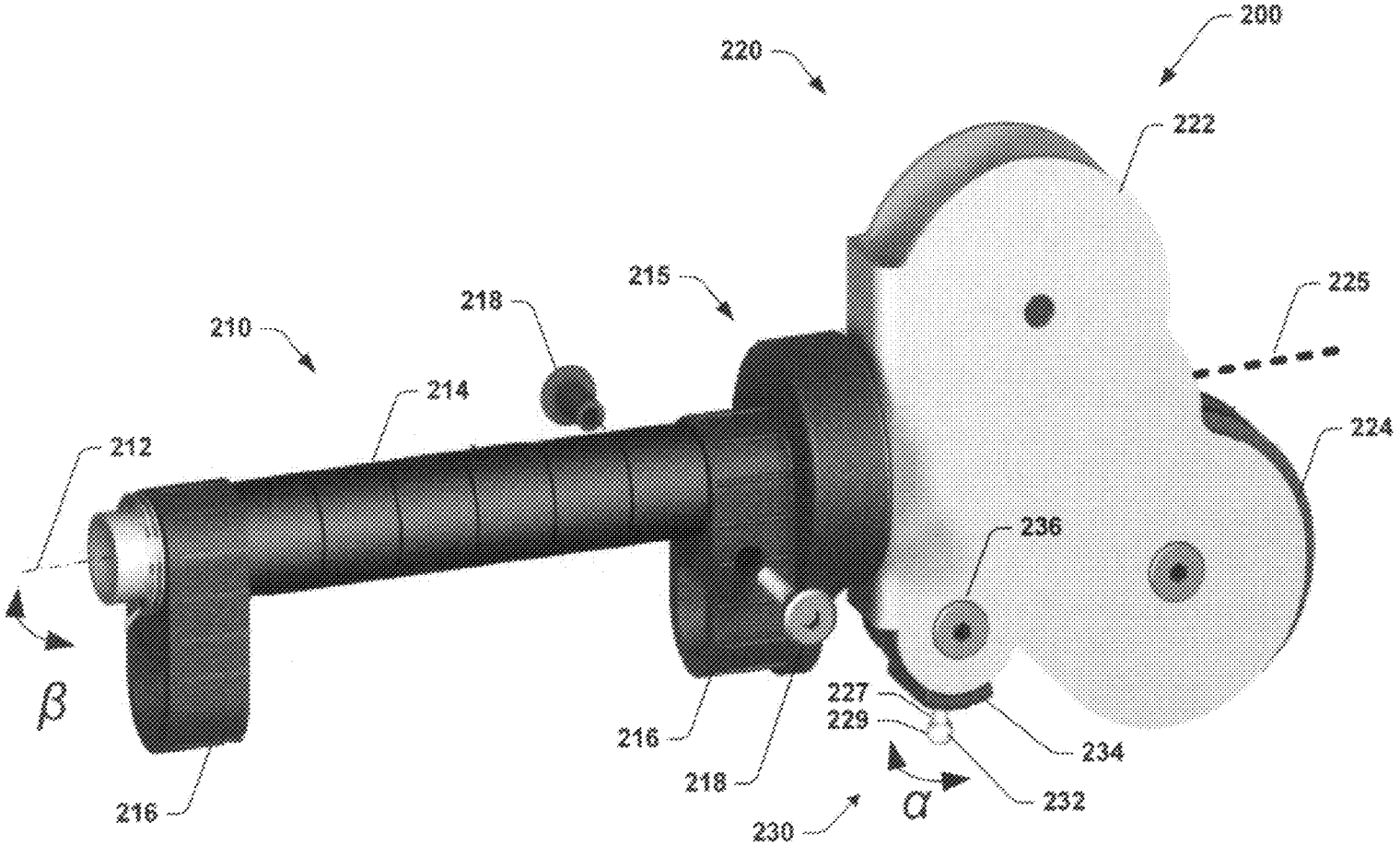
FIG. 2 is an enlarged isometric view of a multi-variable assembly of the exercise assembly of FIG. 1 in accordance with an embodiment of the invention.

FIG. 2 is an enlarged isometric view of the multi-variable assembly 200 of the exercise assembly 100 of FIG. 1. In this embodiment, the multi-variable assembly 200 includes a coupling portion 210 that may be used to couple the multi-variable assembly 200 to the arm 122 of the exercise station 120. A head assembly 220 is rotationally coupled to the coupling portion 210 by a swivel assembly 215. In some embodiments, the swivel assembly 215 includes a ball bearing assembly, a needle bearing assembly, or other suitable structure that allows the head assembly 220 to rotate about a longitudinal axis 212 of the coupling portion 210 (typically parallel to or coincident with a corresponding axis of the arm 122).

More specifically, in the embodiment shown in FIG. 2, the coupling portion 210 includes an elongated member 214 that may be inserted into the distal end portion of the arm 122. Bushings 216 may be coupled to the elongated member 214 and may engage an inner surface of the arm 122 to firmly engage the elongated member 214 with the arm 122. In particular embodiments, the bushings 216 may be configured to engage an arm 122 having a non-circular cross-sectional shape (e.g. oval as shown in FIG. 1, square, rectangular, etc.), or a circular cross-sectional shape, or any other suitable shapes. Fastening devices 218 (e.g. screw and nut) may be used to secure the coupling portion 210 to the arm 122. In further embodiments, the coupling portion 210 may be coupled to the arm 122 in any other suitable manner.

As further shown in FIG. 2, in this embodiment, the head assembly 220 includes a housing 222 that operatively supports one or more rotatable pulleys 224 (one shown), and a rotatable anchor assembly 230. A cable 225 (shown in dashed lines) of a force-transferring assembly may be operatively engaged with the one or more rotatable pulleys 224 for embodiments of exercise machines having a load (e.g. a weight stack, FIG. 9), as described more fully below.

In the embodiment shown in FIG. 2, the anchor assembly 230 includes a projection 232 coupled to a swivel 234 which, in turn, is coupled to the housing 222 by a fastening device 236. The coupling of the swivel 234 to the housing 222 permits the projection 232 to be pivotally adjusted over an angular range α (e.g. 45 degrees, 90 degrees, etc.), while the coupling of the housing 222 to coupling portion 210 by the swivel assembly 215 permits the head assembly 220 to rotate over an angular range β about the longitudinal axis 212 (e.g. up to and including 360 degrees). The projection 232 has a shaft portion 227 and an enlarged head portion 229. It will be appreciated that a variety of alternate anchor assemblies may be conceived in accordance with the teachings of the present disclosure, and the invention is not limited to the exemplary embodiment shown in FIG. 2. For example, in alternate embodiments, the projection 232 could be replaced with a hook (e.g. for engaging a chain, loop, etc.), an eye or loop (e.g. for receiving a hook, etc.), a belt-type or strap-type coupling device, or any other suitable attachment device.

The exercise assembly 100 having the multi-variable assemblies 200 may be used in a wide variety of ways by users, providing improved functionality and versatility over conventional assemblies. Various aspects of the functionality and versatility that may be afforded by the exercise assembly 100 may best be demonstrated by describing some of the various resistance exercises that are enabled by the exercise assembly 100. As used herein, the term "resistance exercise" may be used to describe an exercise that may not require or involve a load (such as a weight stack) other than a user's body weight or a portion thereof.

Figure 3:
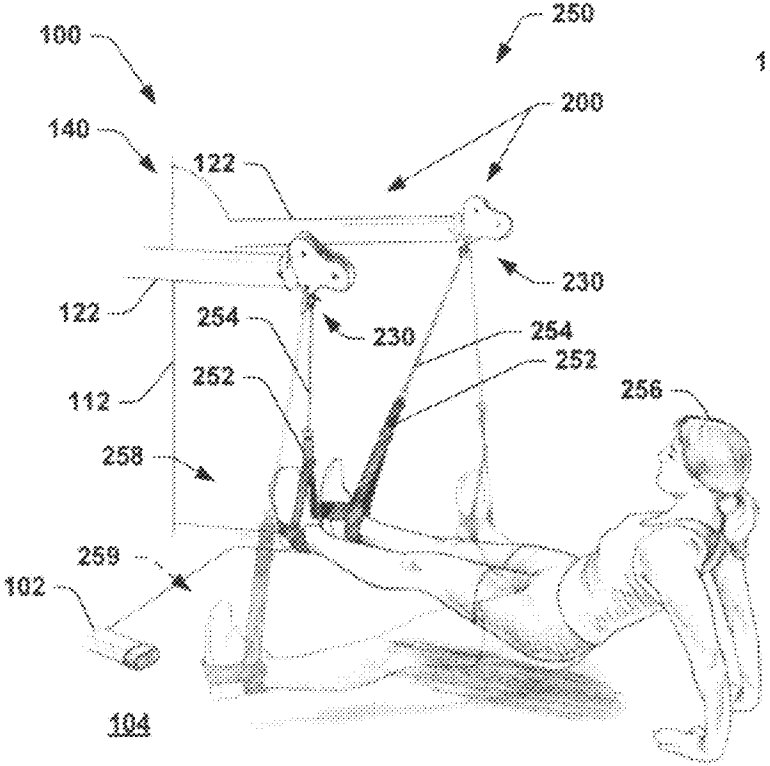

For example, FIG. 3 shows an isometric view of a user 256 performing a resistance exercise 250 using the exercise assembly 100 of FIGS. 1-2 in accordance with the teachings of the present disclosure. For the sake of clarity, only a portion of the exercise assembly 100 is shown. In this embodiment, a foot-engaging harness 252 is attached by a coupling member 254 (e.g. cable, tether, etc.) to the projection 232 (FIG. 2) of each anchor assembly 230 of each multi-variable assembly 200. In operation, the user 256 engages her feet with the foot-engaging harnesses 252, and her hands with the support surface 104, thereby supporting or suspending her body over the support surface 104 by her hands and feet. The user 256 performs the resistance exercise 250 by successively moving her legs from a first position 258 in which her legs are substantially closer together, to a second position 259 (shown in phantom lines) in which her legs are substantially further apart. In some embodiments, the arms 122 of the exercise assembly 100 may be positioned at an intermediate spacing, and the legs of the user 256 in the first position 258 may be closer together than the arms 122, while in the second position 259 the legs of the user 256 may be further apart than the arms 122. Of course, in alternate embodiments, the order of these operations, and the exact positioning of the user's legs, may be varied from that shown in FIG. 3, and may be repeated as many times as desired by the user 256.

During movement of the user's legs between the first and second positions 258, 259, the head assemblies 220 of the multi-variable assemblies 200 may rotate over at least a portion of the angular range β about the longitudinal axis 212. Similarly, during movement of the user's legs between the first and second positions 258, 259, the projections 232 of the anchor assemblies 230 of the multi-variable assemblies 200 may rotate over at least a portion of the angular range α. The rotational movements over the angular ranges α, β by the multi-variable assemblies 200 during the performance of the resistance exercise 250 may advantageously improve the user's satisfaction with the resistance exercise 250 by providing improved degrees of freedom between the user 256 and the exercise assembly 100.

Figure 4:
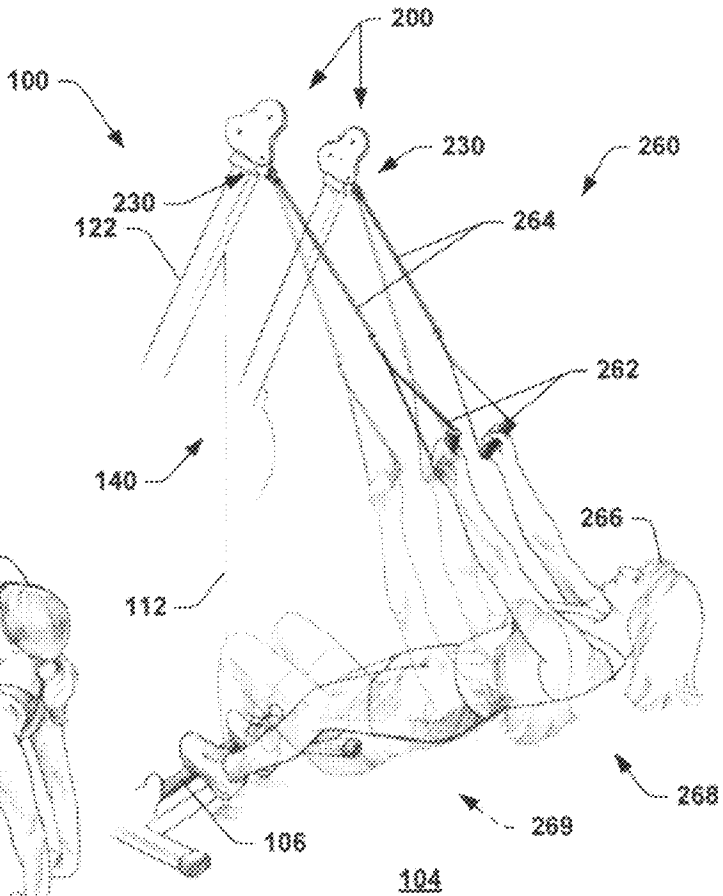
FIGS. 3-8 show isometric views of users performing resistance exercises using the exercise assembly of FIGS. 1-2 in accordance with the teachings of the present disclosure.

FIG. 4 shows an isometric view of a user 266 performing another embodiment of a resistance exercise 260 using the exercise assembly 100 of FIGS. 1-2. In this embodiment, a handle 262 is attached by a coupling member 264 to the projection 232 (FIG. 2) of each anchor assembly 230 of each multi-variable assembly 200. In operation, the user 266 may engage her feet with the foot bar 106, and her hands with the handles 262, and may lean back away from the exercise assembly 100 so that her body is inclined and suspended over the support surface 104. In a first position 268, the user's legs are substantially straight, while in a second position 269 (shown in phantom lines) her knees are bent so that the user's body has rotated downwardly into a squatting position. The user 266 performs the multi-variable exercise 260 by successively moving between the positions 268, 269. Again, in alternate embodiments, the order of these operations, and the exact positioning of the user's body, may be varied from that shown in FIG. 4, and may be repeated as many times as desired by the user 266.

During movement between the first and second positions 268, 269, the head assemblies 220 of the multi-variable assemblies 200 may rotate over at least a portion of the angular range β about the longitudinal axis 212, and the projections 232 (FIG. 2) of the anchor assemblies 230 of the multi-variable assemblies 200 may rotate over at least a portion of the angular range α. As noted above, the rotational movements over the angular ranges α, β by the multi-variable assemblies 200 during the performance of the resistance exercise 260 may advantageously improve the user's satisfaction with the resistance exercise 260 by providing improved degrees of freedom between the user 266 and the exercise assembly 100.

Figure 5:
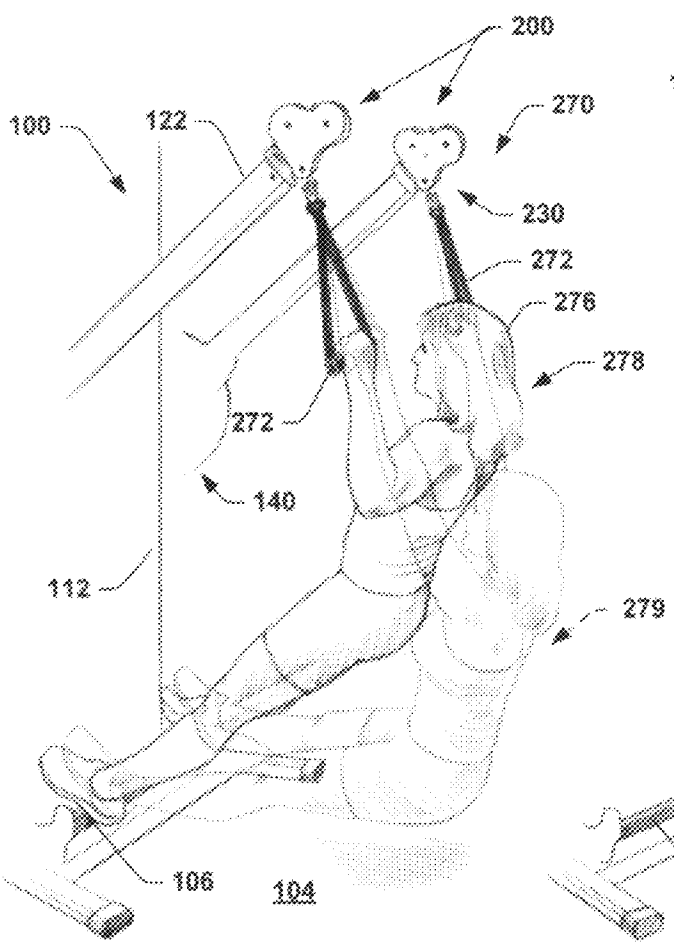

FIG. 5 shows an isometric view of a user 276 performing another embodiment of a resistance exercise 270 using the exercise assembly 100 of FIGS. 1-2. In this embodiment, a handle 272 is attached to the projection 232 (FIG. 2) of each anchor assembly 230 of each multi-variable assembly 200. Again, the user 276 may engage her feet with the foot bar 106, and her hands with the handles 272, and may lean back away from the exercise assembly 100 so that her body is inclined and suspended over the support surface 104. In a first position 278, the user's legs are substantially straight and the user's arms are bent in a "pull up" or "chin up" position. In a second position 279 (shown in phantom lines) the user has straightened her arms and lowered her body toward the support surface 104. The user 276 performs the resistance exercise 270 by successively moving between the positions 278, 279. Again, the head assemblies 220 of the multi-variable assemblies 200 may rotate over at least a portion of the angular range β about the longitudinal axis 212, and the projections 232 (FIG. 2) of the anchor assemblies 230 of the multi-variable assemblies 200 may rotate over at least a portion of the angular range a during movement between the first and second positions 278, 279.

Figure 6:
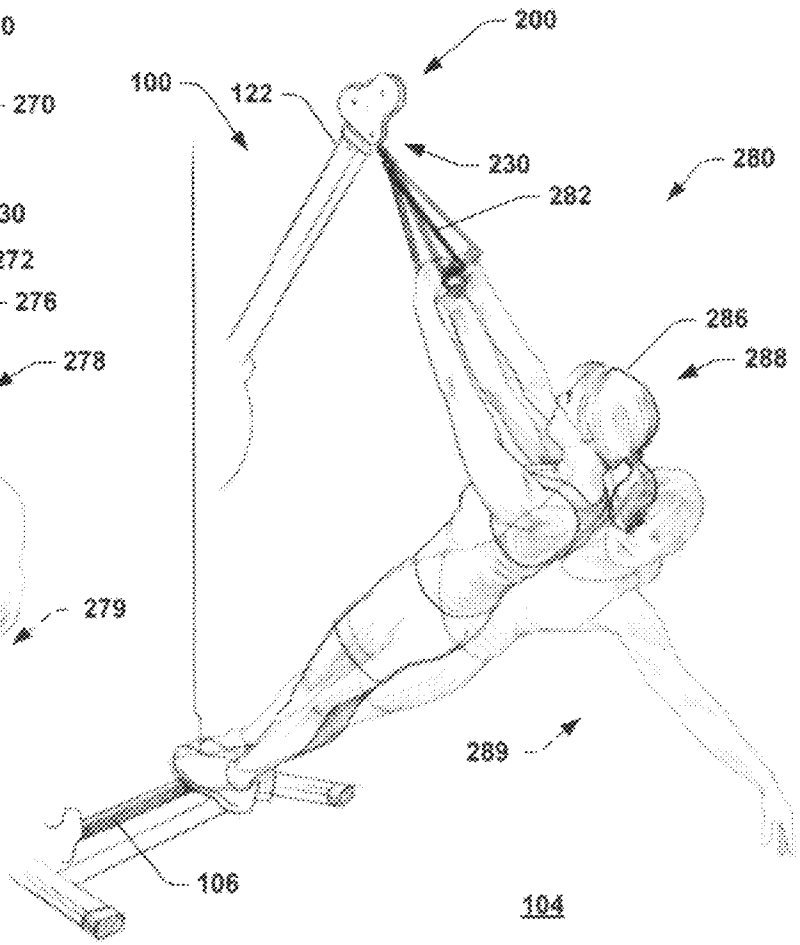

FIG. 6 shows an isometric view of a user 286 performing another embodiment of a resistance exercise 280 using a single multi-variable assembly 200. In this embodiment, a handle 282 is attached to the projection 232 (FIG. 2) of the anchor assembly 230 of the multi-variable assembly 200. Again, the user 286 may engage her feet with the foot bar 106, and her hands with the handle 282, and may lean back away from the exercise assembly 100 so that her body is inclined and suspended over the support surface 104. In a first position 288, the user's hands are engaged with the handle 282 and the user is approximately facing the multi-variable assembly 200. In a second position 289 (shown in phantom lines) the user has released one of her hands from the handle 282 and has rotated her body approximately ninety degrees. The user 286 performs the resistance exercise 280 by successively moving between the positions 288, 289. Again, the head assembly 220 (FIG. 2) of the multi-variable assembly 200 may rotate over at least a portion of the angular range β about the longitudinal axis 212, and the projection 232 of the anchor assembly 230 of the multi-variable assembly 200 may rotate over at least a portion of the angular range a during movement between the first and second positions 288, 289.

Figure 7:
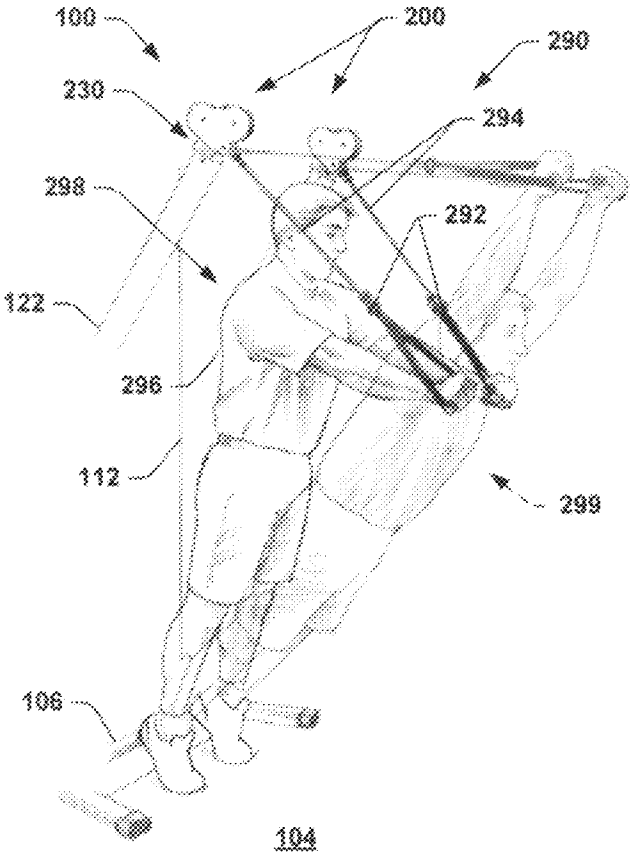

FIG. 7 shows an isometric view of a user 296 performing yet another embodiment of a resistance exercise 290 using the exercise assembly 100 of FIGS. 1-2. In this embodiment, handles 292 are attached to the projections 232 (FIG. 2) of the anchor assemblies 230 of the multi-variable assemblies 200 by coupling members 294. The user 296 may engage his feet with the foot bar 106, or with the support surface 104, or both, and grasps the handles 292. In a first position 298, the user's hands are engaged with the handles 292 and the user's arms are projecting approximately forwardly from the user's body. In a second position 299 (shown in phantom lines) the user has rotated his arms to project approximately upwardly from the user's body, and the user's body has been lowered into a more inclined position with respect to the support surface 104. The user 296 performs the resistance exercise 290 by successively moving between the positions 298, 299. Again, the head assemblies 220 (FIG. 2) of the multi-variable assemblies 200 may rotate over at least a portion of the angular range β about the longitudinal axis 212 (FIG. 2), and the projections 232 of the anchor assemblies 230 of the multi-variable assemblies 200 may rotate over at least a portion of the angular range α during movement between the first and second positions 298, 299.

Figure 8:
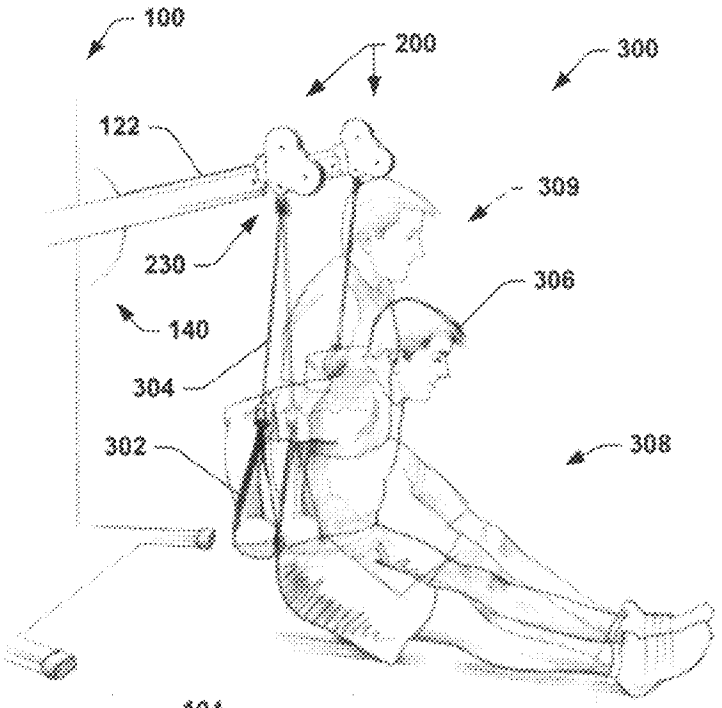

Still another embodiment of a resistance exercise 300 using the exercise assembly 100 of FIGS. 1-2 is shown in FIG. 8. In this embodiment, handles 302 (one visible) are attached to the projections 232 (FIG. 2) of the anchor assemblies 230 of the multi-variable assemblies 200 by coupling members 304 (one visible). A user 306 engages his feet with the support surface 104 and grasps the handles 302. In a first position 308, the user's hands are engaged with the handles 302 and the user's arms are bent such that the user's body is suspended above the support surface 104. In a second position 309 (shown in phantom lines) the user has straightened his arms to raise his body away from the support surface 104. The user 306 performs the resistance exercise 300 by successively moving between the positions 308, 309. Again, the head assemblies 220 (FIG. 2) of the multi-variable assemblies 200 may rotate over at least a portion of the angular range β about the longitudinal axis 212 (FIG. 2), and the projections 232 of the anchor assemblies 230 of the multi-variable assemblies 200 may rotate over at least a portion of the angular range a during movement between the first and second positions 308, 309.

Figure 9:
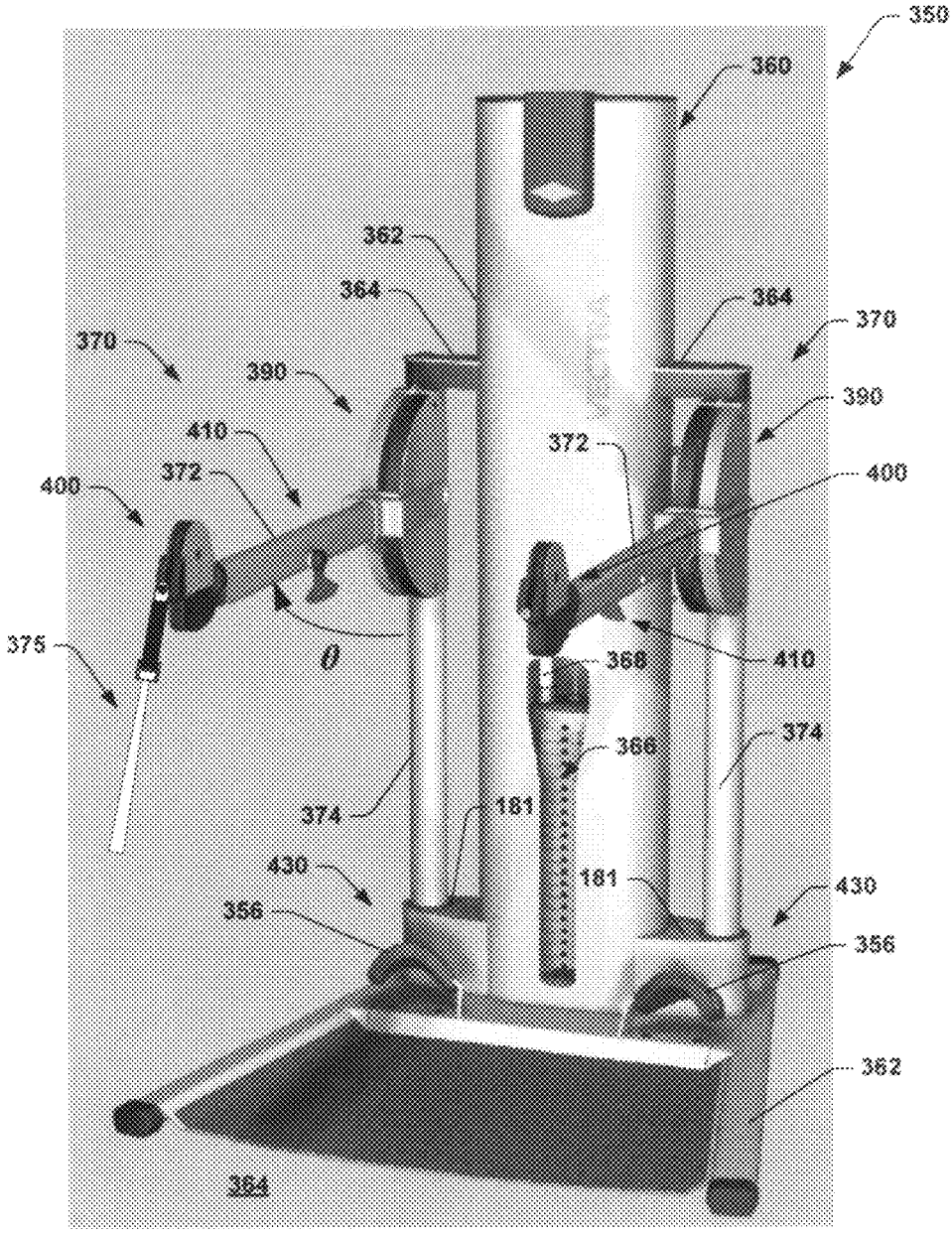
FIG. 9 is an isometric view of another embodiment of an exercise assembly in accordance with the teachings of the present disclosure.

It will be appreciated that, in alternate embodiments, resistance training apparatus and methods in accordance with the present disclosure may be associated with exercise assemblies having a load (e.g. a weight stack), a force-transferring assembly (e.g. a cable-and-pulley assembly), or other components associated with conventional exercise assemblies. For example, FIG. 9 is an isometric view of another embodiment of an exercise assembly 350 in accordance with the teachings of the present disclosure. In this embodiment, the exercise assembly 350 includes an upwardly extending central portion 360 coupled to a base assembly 362 that rests on a support surface 364 (e.g. a floor). The base assembly 362 may include foot engagers 356 for securing a user's feet during an exercise, as described in co-pending, commonly-owned U.S. patent application Ser. No. 11/771,738 filed on Jun. 29, 2007, which application is incorporated herein by reference. In the embodiment shown in FIG. 9, the central portion 360 includes a shield member 362 and a pair of support members 364 that extend laterally outwardly from the shield member 362. A weight stack 366 is positioned within the shield member 362, each weight of the weight stack 366 being slideably mounted on one or more guide rods 368 (FIGS. 9 and 10) that are disposed within the shield member 362.

As further shown in FIG. 9, the exercise assembly 350 includes a pair of exercise stations 370 that enable a user to perform a variety of exercises. More specifically, each exercise station 370 includes an arm 372 coupled to an upright support 374 by a first adjustment assembly 390. A multi-variable assembly 400 is coupled to a distal end portion of each arm 372. In some embodiments, the multi-variable assemblies 400 may be substantially similar to the multi-variable assemblies described above with respect to FIG. 2.

A handle 375 may be coupled to a force-transfer assembly (e.g. a cable 225, see FIG. 2) proximate the multi-variable assembly 400 at the distal end of the arm 372, operatively coupling the exercise handle 375 to the weight stack 366. The upright support 374 extends from the support member 364 of the central portion 360 to a second adjustment assembly 430 proximate the base assembly 352. The first and second adjustment assemblies 390, 430 of the exercise station 350 may advantageously provide adjustability of the position of the arm 372 (and thus the exercise handle 375) for performing exercises, as described more fully in co-pending, commonly-owned U.S. patent application Ser. No. 11/833,220 filed on Aug. 2, 2007, which application is incorporated herein by reference.

As described more fully in the previously-incorporated by reference U.S. patent application Ser. No. 11/833,220, the first and second adjustment assemblies 390, 430 allow a user to adjust both the vertical position and the horizontal position of the arms 372 (and thus the exercise handle 375 or user interface) by simple actuating an actuator assembly 410. More specifically, a user may adjust either the vertical position or the horizontal position independently, or the user may adjust both vertical and horizontal positions simultaneously or sequentially as desired.

Figure 10:
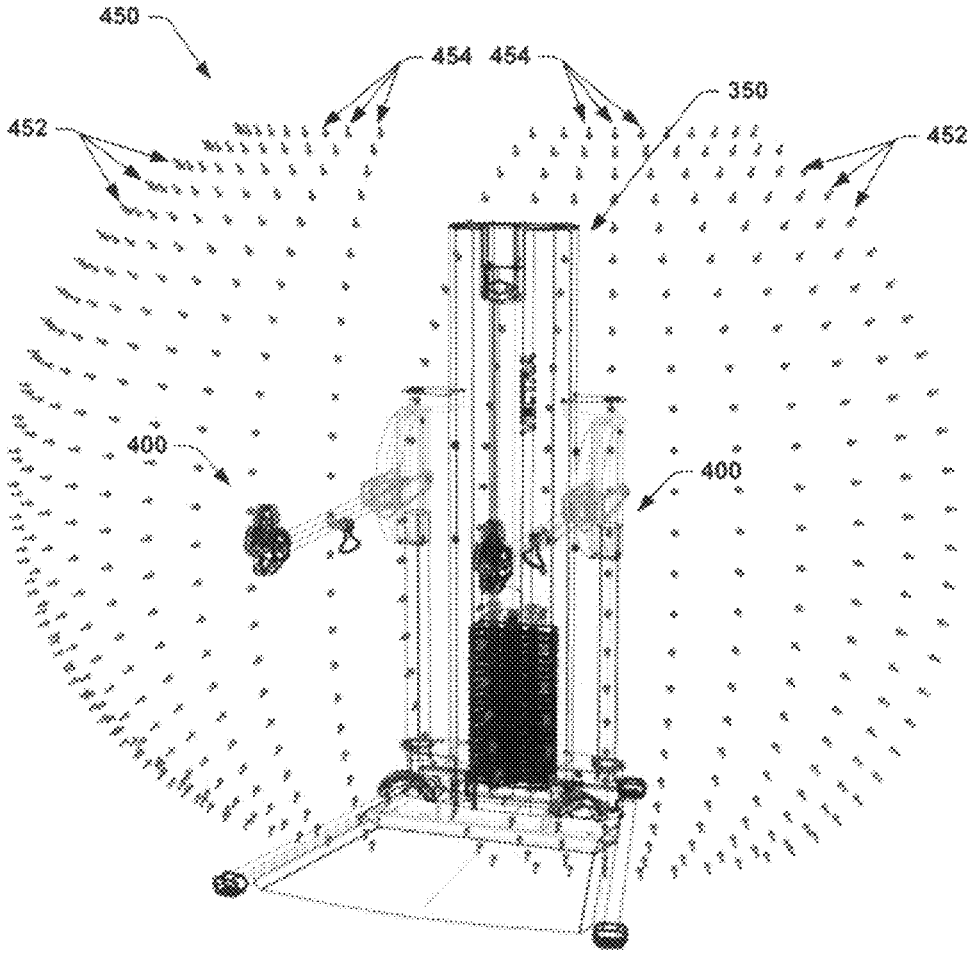
FIG. 10 shows the exercise assembly of FIG. 9 surrounded by an exemplary locus of possible arm positions in accordance with various embodiments of the present disclosure.

For example, FIG. 10 shows the exercise assembly 350 of FIG. 9 surrounded by an exemplary locus 450 of possible positions of the multi-variable assemblies 400 that may be achieved using the upper and lower adjustment assemblies 390, 430 in accordance with embodiments of the present disclosure. It will be appreciated that the exercise assembly 100 of FIG. 1 may also be adjustably positioned to place the multi-variable assemblies 200 in one or more positions of a substantially similar locus of possible positions. As shown in FIG. 10, the position locus 450 is illustrated as intersection points between a plurality of elevational rows 452 and a plurality of azimuthal columns 454. Of course, in alternate embodiments, the positions within the position locus 450 may be distributed in a variety of different ways depending on, for example, the configuration of the one or more adjustment assemblies, and may include random positions, non-uniform positions, or any other suitable distribution of possible positions of the user interface.

In some embodiments, the number (and spacing) of the elevational rows 452 of the position locus 450 may be determined by structural aspects of the adjustment assemblies 390, 430 (e.g. the number (and spacing) of indexing slots, teeth, etc.). Thus, in alternate embodiments, a greater or fewer number of rows 452 and columns 454, or a different spacing (or density) of rows 452 and columns 454, may be achieved.

Referring again to FIG. 9, after adjustment of one or more of the exercise stations 370, the user may perform a desired exercise using the exercise assembly 350. More specifically, the user may couple a suitable user interface (e.g. harnesses 252 shown in FIG. 3, handles 262 shown in FIG. 4, etc.) to the anchor assemblies 230 of the multi-variable assemblies 400 to perform any of the resistance exercises 250-300 described above with respect to FIGS. 3-8. Alternately, the user may apply a training force on the exercise handle 375 (or other suitable user interface). As noted above, the exercise handle 375 is coupled to the weight stack 366 via a force-transfer assembly (e.g. cable 225 shown in FIG. 2). A variety of different force-transfer assemblies may be used to couple the exercise handle 375 to the weight stack 366 or other suitable training load. In some embodiments, a cable-and-pulley assembly may be employed, as fully described in the previously incorporated-by-reference U.S. patent application Ser. No. 11/833,220, or as generally described in U.S. Pat. No. 6,582,346 issued to Lines et al., U.S. Pat. No. 6,482,135 issued to Ish et al., and U.S. Pat. No. RE 34,572 issued to Johnson et al., which patents are incorporated herein by reference. In this way, embodiments of resistance training apparatus and methods in accordance with the teachings of the present disclosure may advantageously enable both conventional weight-training exercises, as well as novel resistance exercises as described above.

Figure 11:
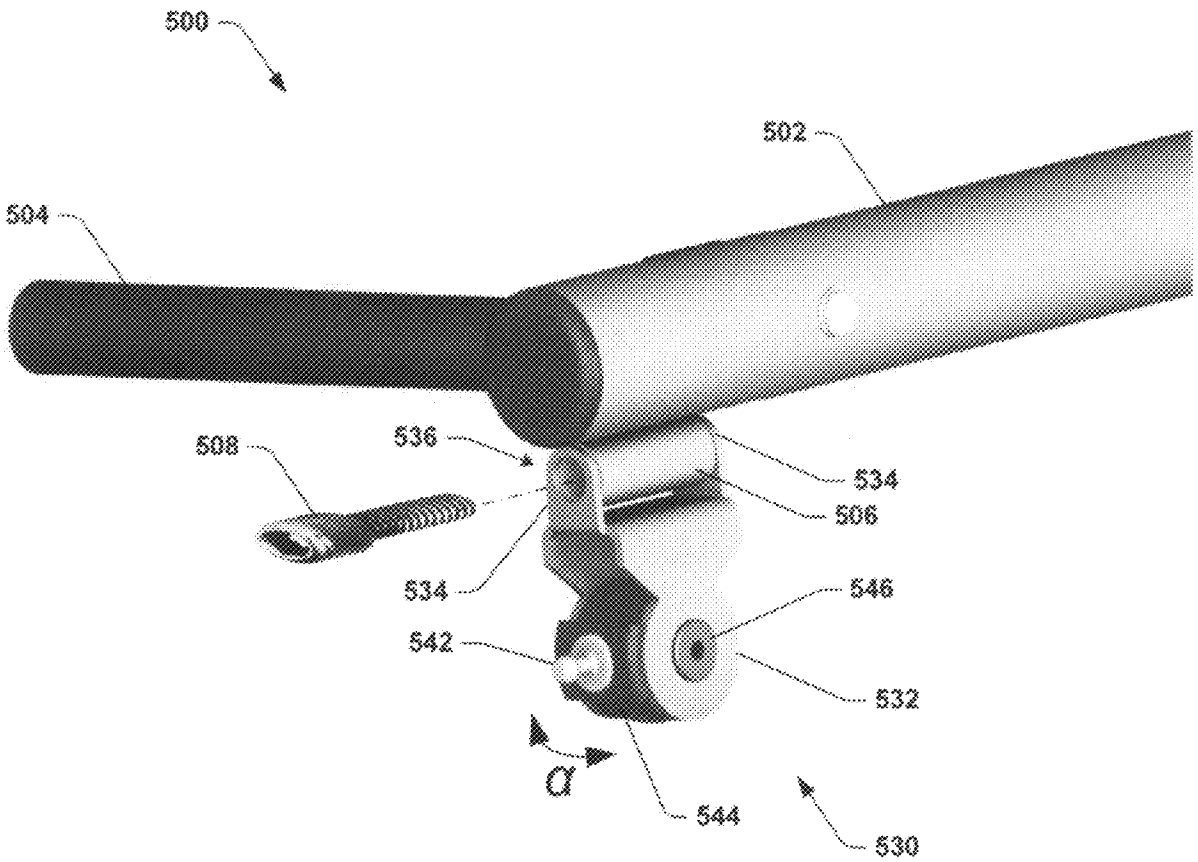
FIG. 11 is a partial isometric view of another embodiment of an exercise assembly that includes an anchor assembly in accordance with the teachings of the present disclosure.

It will be appreciated that a variety of alternate anchor assemblies may be conceived in accordance with the teachings of the present disclosure, and the invention is not limited to the exemplary embodiments described above. For example, FIG. 11 is a partial isometric view of another embodiment of an exercise assembly 500 that includes an anchor assembly 530 in accordance with the teachings of the present disclosure. In this embodiment, the exercise assembly 500 includes a support arm 502 having a laterally-projecting handle 504. The support arm 502 may be any suitable stationary or moveable component, including but not limited to those components disclosed, for example, in previously-incorporated-by-reference U.S. Pat. No. 6,582,346 issued to Lines et al., U.S. Pat. No. 6,482,135 issued to Ish et al., and U.S. Pat. No. RE 34,572 issued to Johnson et al.

The anchor assembly 530 includes a bracket 532 coupled to the support arm 502. More specifically, the bracket 532 includes a pair of flanges 534 having apertures 536 that align with opposing end portions of a mount portion 506 of the support arm 502. In some embodiments, the mount portion 506 comprises a tubular portion that is attached (e.g. welded) to the support arm 502, and a fastener 508 (e.g. a threaded fastener) may be inserted through the flanges 534 and the mount portion 506 to secure the anchor assembly 530 to the support arm 502. In alternate embodiments, any other suitable method of attaching the bracket 532 to the support arm 502 may be used.

As further shown in FIG. 11, the anchor assembly 530 further includes a projection 542 coupled to a swivel 544 which, in turn, is coupled to the bracket 532 by a fastening device 546. The coupling of the swivel 544 to the bracket 532 permits the projection 542 to be pivotally adjusted over an angular range $\alpha$ (e.g. 45 degrees, 90 degrees, etc.). Thus, anchor assemblies in accordance with the teachings of the present disclosure may be used independently of pulleys, cables, or other components to advantageously enable users to perform resistance exercises as described above.

Figure 12:
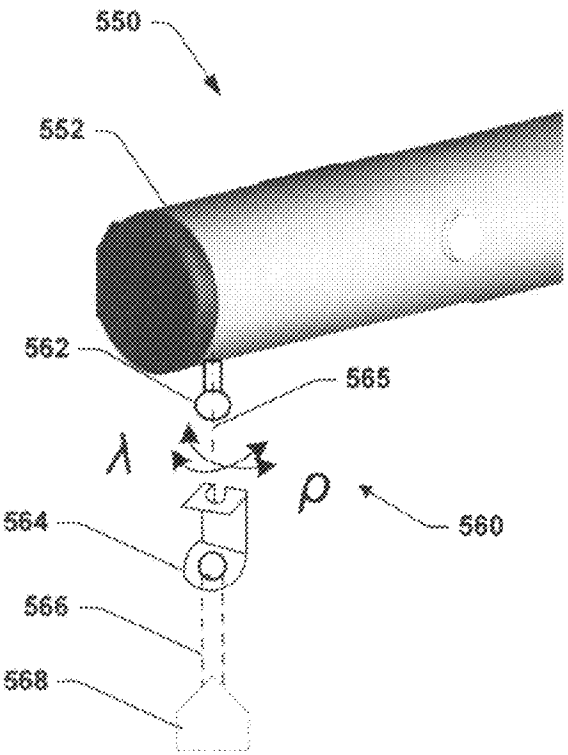
FIG. 12 is a partial isometric view of another embodiment of an exercise assembly that includes an anchor assembly in accordance with the teachings of the present disclosure.

In some embodiments, an anchor assembly in accordance with the teachings of the present disclosure may include a coupling device having a first portion that is fixedly or rigidly attached to a support portion (e.g. a support arm) of an exercise assembly, and a second portion that couples to the first portion that provides the desired degrees of freedom motion with respect to the fixed first portion. For example, FIG. 12 is a partial isometric view of another embodiment of an exercise assembly 550 that includes an anchor assembly 560 in accordance with the teachings of the present disclosure. In this embodiment, the anchor assembly 560 includes a first portion 562 that is rigidly coupled to a support arm 552. The first portion 562 may, for example, be configured to resemble the projection 232 described above with respect to FIG. 2. A second portion 564 of the anchor assembly 560 (shown in FIG. 12 in a disengaged position from the first portion 562 for the sake of clarity) moveably engages with the first portion 562. A user interface 568 (e.g. handle, etc.) (shown in dashed lines in FIG. 12) may be coupled to the second portion 564 using a coupling device 566 (shown in dashed lines in FIG. 12) for performing any suitable exercises.

In this embodiment, the second portion 564 may be detachable from the first portion 562, and is able to rotate about an axis 565 of the first portion 562. The second portion 564 is also able to swing from the first portion 562 through a first angular range $\lambda$ that lies within a plane that includes the support arm 552, and also swings from the first portion 562 through a second angular range $\rho$ that lies within a plane that is transverse (or perpendicular) to the plane that includes the support arm 552. It will be appreciated that in at least some embodiments, the second portion 564 may move with respect to the first portion 562 through one or more of the above-referenced degrees of freedom either sequentially or simultaneously. As described more fully above, the rotational and/or pivotal (or swinging) movements over the angular ranges by the second portion 564 of the anchor assembly 560 during the performance of an exercise may advantageously improve the user's satisfaction with the exercise by providing improved degrees of freedom between the user and the exercise assembly 550.

Figure 13:
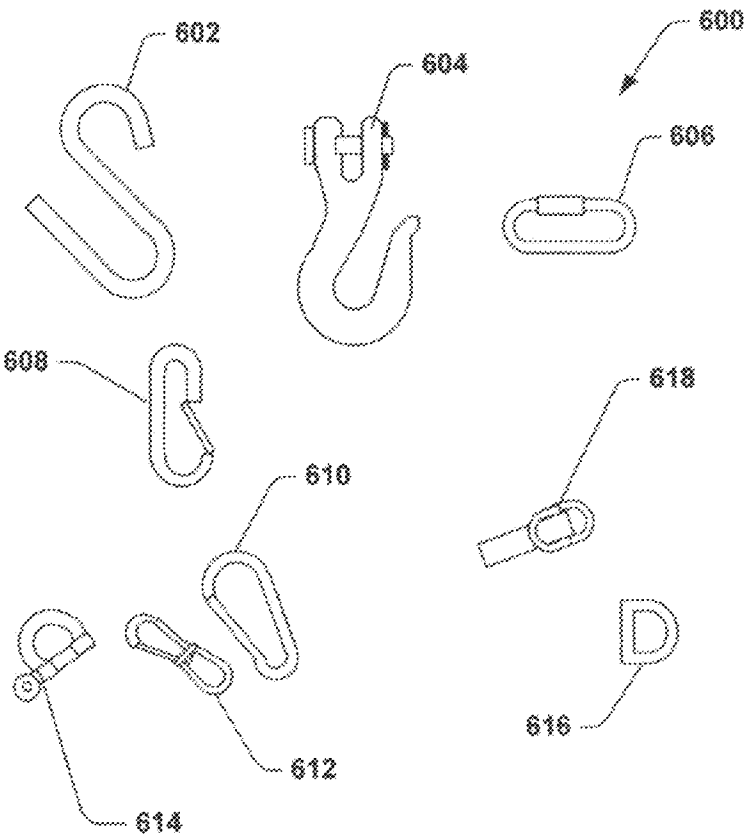
FIG. 13 is collage of various anchor devices that may be used in various embodiments of anchor assemblies in accordance with the teachings of the present disclosure.

Of course, the anchor assembly 560 shown in FIG. 12 is merely exemplary, and a wide variety of coupling components may be used in place of the first and second portions 562, 564 without departing from the spirit and scope of the invention. For example, FIG. 13 shows a collage 600 of various possible coupling components that may be suitably used in various alternate embodiments of anchor assemblies in accordance with the teachings of the present disclosure. More specifically, possible coupling components 600 that may suitable serve as one or more of the first and second portions 562, 564 (FIG. 12) include, but are not limited to, one or more of "S" hooks 602, chain hooks 604, chain links 606, clip hooks 608, caribiners (or snap links) 610, snap swivels 612, eyes 614, "D" rings 616, and/or double-D ring straps 618. Of course, in further embodiments, any other suitable coupling devices may be used that provide the desired degrees of freedom between the user and the exercise assembly during an exercise.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An exercise assembly, comprising:

an exercise station having an adjustably positionable, outwardly extending support portion and at least one user interface operatively coupled to the outwardly extending support portion by a head assembly, wherein the head assembly includes:

a housing rotatably attached to the outwardly extending support portion and configured to rotate about a longitudinal axis, the longitudinal axis being at least one of parallel with or coincident with a corresponding axis of the outwardly extending support portion; and an anchor assembly operatively coupled to the housing and having a coupling device that is pivotable with respect to the housing and moveable throughout an angular range in a plane that includes the longitudinal axis, the coupling device being coupled to the at least one user interface and configured to pivot through at least a portion of the angular range during use of the at least one user interface, the coupling device further being pivotably attached to the housing by a swivel operatively coupled to the housing.

2. The exercise assembly of claim 1, wherein the coupling device includes a shaft portion coupled to the swivel, and an enlarged head portion coupled to the shaft portion.

3. The exercise assembly of claim 1, wherein the outwardly extending support portion includes at least one elongated arm having an arm longitudinal axis, the housing of the head assembly being rotatably coupled to the at least one elongated arm and rotatable about the arm longitudinal axis.

4. The exercise assembly of claim 3, wherein the housing of the head assembly is rotatably coupled to a distal end portion of the at least one elongated arm by a bearing assembly.

5. The exercise assembly of claim 1, further comprising:

a load; and a force-transferring assembly operatively coupled between the load and the head assembly and configured such that a training force applied by a user to the at least one user interface is at least partially transmitted by the head assembly and the force-transferring assembly to the load.

6. The exercise assembly of claim 5, wherein the force-transferring assembly includes a cable-and-pulley assembly.

7. An exercise assembly, comprising:

an adjustably positionable, outwardly extending support portion configured to at least partially support a weight of a user during an exercise; and a multi-variable assembly operatively coupled to the outwardly extending support portion, wherein the head assembly includes:

a coupling portion fixedly coupled to a distal end portion of the outwardly extending support portion;

a head assembly including:

a housing that is rotatably coupled to the coupling portion and configured to rotate about a longitudinal axis, the longitudinal axis being at least one of parallel with or coincident with a corresponding axis of the outwardly extending support portion; and an anchor assembly operatively coupled to the housing and having a coupling device that is pivotable throughout an angular range in a plane that includes the longitudinal axis, the coupling device being configured to be coupled to a user interface that engages the user during the exercise, the coupling device including a projection having a shaft portion, and an enlarged head portion coupled to the shaft portion.

8. The exercise assembly of claim 7, wherein the housing of the head assembly is configured to rotate about an axis of the coupling portion, and wherein the coupling device is configured to pivot with respect to the coupling portion through a first angular range within a first plane, and rotate with respect to the coupling portion through a second angular range within a second plane perpendicular to the first plane.

9. The exercise assembly of claim 7, wherein the outwardly extending support portion includes an elongated arm, the multi-variable assembly being coupled to the elongated arm proximate a distal end thereof.

10. The exercise assembly of claim 7, further comprising:

a load;

a second user interface; and a force-transferring assembly operatively coupled to the load and to the outwardly extending support portion, and being configured such that a training force applied by a user to the second user interface is at least partially transmitted by the force-transferring assembly to the load.

11. A method of exercising comprising:

engaging a user with at least one user interface of an exercise apparatus having an adjustably positionable, outwardly extending support portion, the at least one user interface being operatively coupled to the outwardly extending support portion by a head assembly, wherein the head assembly includes:

a housing rotatably attached to the outwardly extending support portion and configured to rotate about a longitudinal axis, the longitudinal axis being at least one of parallel with or coincident with a corresponding axis of the outwardly extending support portion; and an anchor assembly operatively coupled to the housing and having a coupling device that is pivotable with respect to the housing and moveable throughout an angular range in a plane that includes the longitudinal axis, the coupling device being coupled to the at least one user interface and configured to pivot through at least a portion of the angular range during use of the at least one user interface, the coupling device further being pivotably attached to the housing by a swivel operatively coupled to the housing;

exerting at least part of the weight of the user on the at least one user interface;

moving at least part of the user between a first position and a second position, including one or more of exerting or releasing a training force applied to the at least one user interface, wherein the training force counteracts at least a portion of the weight of the user; and simultaneously with the one or more of exerting or releasing a training force applied to the at least one user interface, pivoting the coupling device at least partially through the angular range.

12. The method of claim 11, wherein pivoting the coupling device at least partially through the angular range includes:

pivoting the coupling device with respect to the housing.

13. The method of claim 11, wherein:

engaging a user with at least one user interface includes engaging a user hand with a handle operatively coupled to the coupling device; and wherein moving at least part of the user between a first position and a second position includes at least one of raising or lowering the user with respect to a gravitational direction.

14. The method of claim 11, wherein:

engaging a user with at least one user interface includes engaging a user foot with a harness operatively coupled to the coupling device; and wherein moving at least part of the user between a first position and a second position includes at least one of raising or lowering the user with respect to a gravitational direction.

* * * * *